United States Patent [19]

Lawson et al.

[11] Patent Number: 4,507,813

[45] Date of Patent: Apr. 2, 1985

[54] TOILET SEAT AND LID LOCK

[76] Inventors: William J. Lawson, R.D. 1, Box 299E, Milton, Del. 19968; William L. Gunter, 1904 Kingswood Dr., Salisbury, Md. 21801

[21] Appl. No.: 525,441

[22] Filed: Aug. 22, 1983

[51] Int. Cl.[3] ..... A47K 13/00

[52] U.S. Cl. ..... 4/253; 292/210

[58] Field of Search ..... 4/251, 253; 292/DIG. 49, 210, 238, 304; 16/323, 324, 333, 347, 349

[56] References Cited

U.S. PATENT DOCUMENTS

| | | | |
|---|---|---|---|
| 856,937 | 6/1907 | Bell | 16/333 |
| 1,544,657 | 7/1925 | Langer | 292/DIG. 49 |
| 3,902,757 | 9/1975 | Yoshimura | 16/324 X |
| 4,458,379 | 7/1984 | Shelton | 16/324 X |

*Primary Examiner*—Charles E. Phillips

*Attorney, Agent, or Firm*—B. P. Fishburne, Jr.

[57] ABSTRACT

An automatically engageable and quickly and easily releasable locking device for a toilet seat and lid is disclosed. A single mounting bar attached to the underside of the lid carries a pivoted spring-biased locking arm which is released by simple finger pressure and returns automatically to a positive locking position in contact with a stop whenever the lid is closed. No reconstruction or alteration of the conventional toilet bowl or seat and lid structure is required. The locking arm may also be gravity returned to its locking position without spring action.

5 Claims, 5 Drawing Figures

FIG. 1
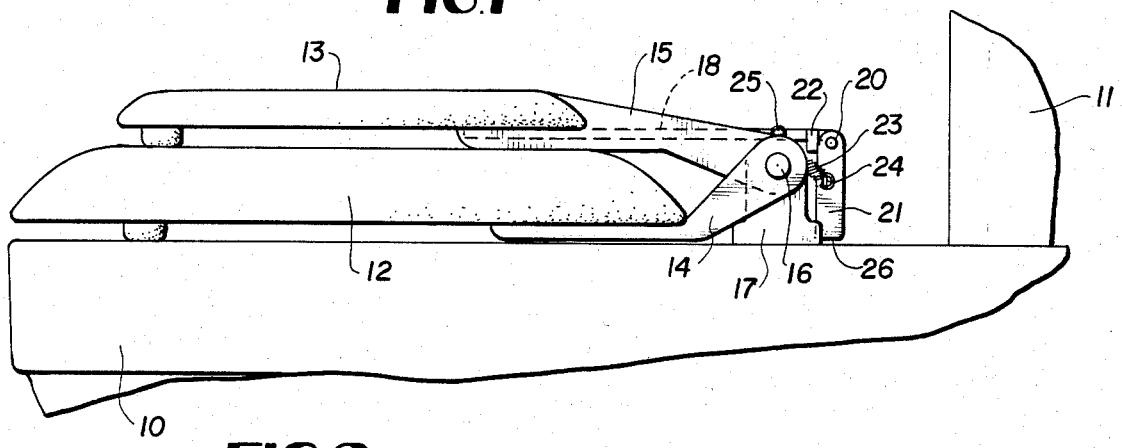
FIG. 2
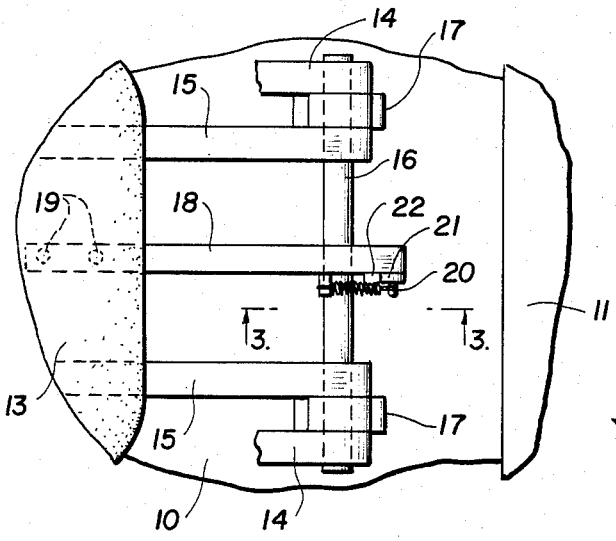
FIG. 3
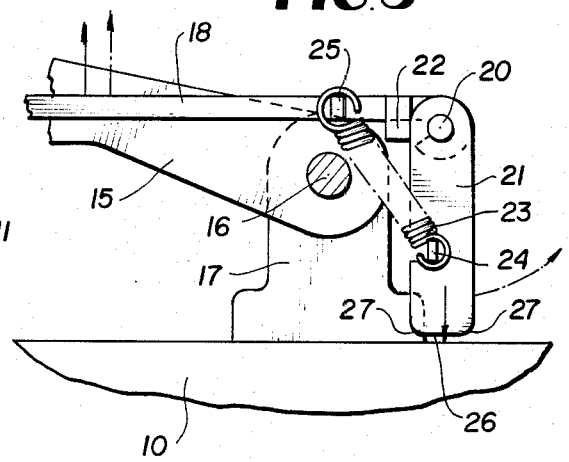
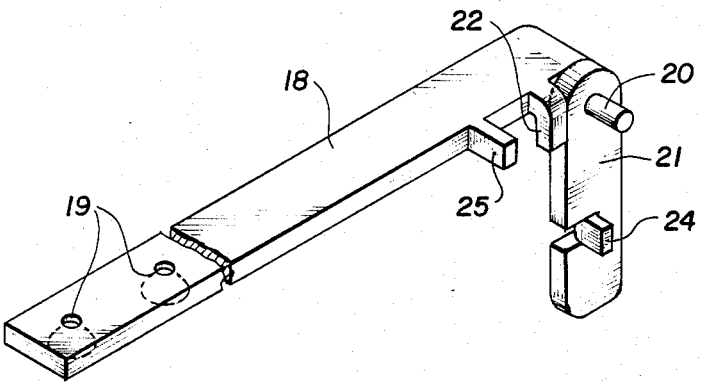
FIG. 5
FIG. 4
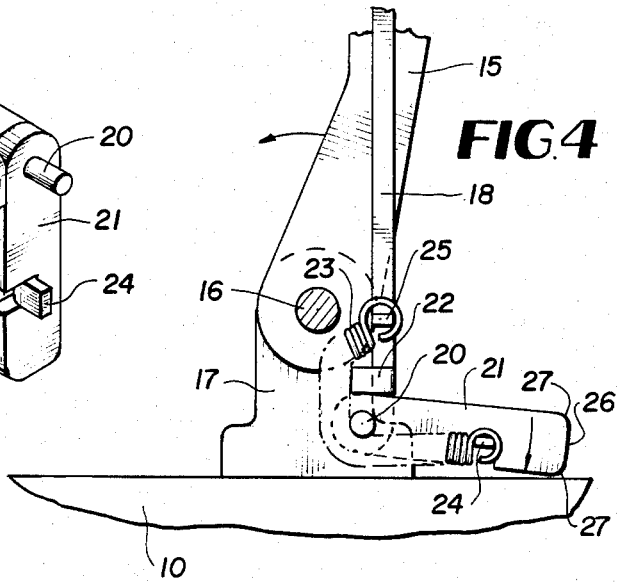

TOILET SEAT AND LID LOCK

BACKGROUND OF THE INVENTION

This invention has for its objective the provision of a very simple and entirely practical solution for a recognized safety hazard in the home which heretofore has not been dealt with in a satisfactory manner.

The problem concerns the safety hazard to small children mainly in the one to three year old categories presented by toilet bowls filled with water without any seat and lid locking means. In such unguarded situations, the child can easily drown head-down in the bowl and this happens on a far too frequent basis each year in the United States. Also, small pets can be similarly drowned and sewer systems are easily cloged up as a result of children placing foreign objects, such as toys, in the toilet bowl.

The prior patented art reveals a number of teachings attempting to deal with the above problem but in no known instance is the patented solution satisfactory and entirely practical and, therefore, no toilet seat and lid locking device on a wide commercial scale has yet been adopted. Therefore, the safety hazard continues to exist unabated.

The reason why no prior art device has yet been adopted widely on a commercial basis is that most prior art proposals involve structures which are too costly which require substantial modification of the conventional bowl and/or seat and lid structures, and are not completely automatic in locking the lid and seat whenever the lid is returned to the closed position. In essence, the prior art proposals have not been operationally adequate and convenient and have not been economically feasible or practical.

The present invention is believed to offer a very inexpensive, highly convenient, completely automatic and therefore entirely practical solution to the above-noted safety hazard. A simple locking device in the form of an attachment to a toilet seat lid requires no structural modification of the toilet bowl or the standard seat and lid or its hinges. A single mounting bar attached to the bottom of the lid carries a pivoted locking arm at its rear end between the seat and lid hinge structure, with the locking arm disposed slightly rearwardly thereof. The rigid locking arm is biased by a spring to a positive seat and lid locking position. Whenever the lid is closed the positive locking arm moves automatically and unfailingly to its locking position where it engages a stop. In this position, it is impossible to raise the toilet seat or its lid, and hence a child is protected. The locking arm can be shifted to a release position against spring force by the mere flick of a finger, allowing the seat and lid to be swung to a full open position in the normal manner.

Other features and advantages of the invention will become apparent to those skilled in the art during the course of the following description.

BRIEF DESCRIPTION OF THE DRAWINGS

FIG. 1 is a side elevation of a toilet seat and lid equipped with a locking device according to the invention with the device in the active locking position.

FIG. 2 is an enlarged fragmentary plan view of a locking device shown in FIG. 1.

FIG. 3 is a fragmentary vertical section taken on line 3—3 of FIG. 2.

FIG. 4 is a view similar to FIG. 3 with the seat and lid lock in a release position and with the lid fully elevated.

FIG. 5 is a perspective view of the locking attachment according to the invention, parts omitted.

DETAILED DESCRIPTION

Referring to the drawings in detail wherein like numerals designate like parts, the numeral 10 designates a conventional toilet bowl on the rear of which is mounted an upstanding flush tank 11. A toilet seat 12 and an overlying lid 13 are conventionally pivotally connected through hinge arms 14 and 15 with a transverse horizontal shaft 16 held by anchors 17 fixed on the top surface of the bowl 10 near and forwardly of the flush tank 11, so that the shaft 16 is supported somewhat above the top surface of the bowl 10. The construction thus far described is conventional, and typical of the most widely used form of toilet structure found in homes and elsewhere.

The invention proper which is a highly simplified locking attachment for the lid 13 comprises a straight mounting bar 18 attached to the bottom surface of the lid 13 near its rear end and at its transverse center. The bar 18 is apertured at 19 near its forward end to receive suitable attaching screws, and the bar extends well rearwardly of the lid 13 to a point somewhat rearwardly of the seat and lid pivot shaft 16, the bar 18 lying somewhat above the shaft 16 in a horizontal position, when the lid 13 and seat 12 are closed.

At its rear end and projecting beyond one side thereof, the bar 18 carries a pivot pin 20 on which a comparatively short rigid locking arm 21 is pivotally suspended. A rigid stop lug 22 is provided on the bar 18 just forwardly of the pivot pin 20 to arrest swinging movement of the locking arm 21 in one direction, namely, in the clockwise direction, FIGS. 1 and 3, when the arm 21 is in the vertical seat and lid locking position.

The locking arm 21 is resiliently biased in this locking position against the stop 22 by a retractile spring 23 having its opposite ends attached to lugs 24 and 25 on the arm 21 and the bar 18, respectively. The spring anchor lug 25 is on the same side of the bar 18 as the stop lug 22 and spaced somewhat forwardly thereof. The lug 24 is on the corresponding side of locking arm 21, as best shown in FIG. 5. The locking arm 21 has a generally square end face 26 preferably with rounded corners 27 to facilitate smooth operation of the lock.

OPERATION

Whenever the lid 13 and seat 12 are closed and in horizontal positions, the spring 23 pulls the locking arm 21 against the stop lug 22, whereby the locking arm is held vertically at right angles to the bar 18, and with its end face 26 closely adjacent to the top face of toilet bowl 10. In this condition, it is impossible for a child or other person to elevate the lid 13 or the seat 12 and lid. The rigid locking arm 21 prevents such action by solidly engaging the top face of the toilet bowl.

When an adult wishes to raise the lid 13 or the toilet seat and lid, the only action required is to engage the pivoted locking arm 21 with a finger and push it rearwardly or counterclockwise against the action of spring 23 sufficiently for the end face 26 to move clear of the toilet bowl top face, following which the seat and lid, or lid alone, can be raised in the normal manner to the full open position where the lid is slightly past the vertical with respect to the axis of shaft 16 and may rest by gravity against the front of the tank 11. During this normal opening operation, the spring 23 will continue to stretch and the locking arm 21 will continue to engage the top face of the toilet bowl and will pivot around the element 20 until it finally assumes a near level position as shown in FIG. 4 and nearly perpendicular position relative to the bar 18 which is now substantially vertical. The spring 23 during this activity can engage the projecting pivot pin 20 and bend around the same as shown in FIG. 4.

When the lid or seat and lid is again lowered to the position shown in FIG. 1, the locking arm 21 under spring force will faithfully return itself automatically to the safety locking position against the stop lug 22 and substantially perpendicular to the top face of the toilet bowl. No action by the user is required except an initial displacing of the locking arm 21 slightly away from the vertical locking position shown in FIGS. 1 and 3, following which the locking arm 21 will cam itself automatically toward the position shown in FIG. 4 as the lid 13, or lid and seat, continue to be elevated to the full open position.

The arrangement is completely reliable and safe, highly convenient, very inexpensive to manufacture and install, and is compatible with the most common toilet fixture structures without requiring them to be modified. Most importantly, the device is essentially child-proof in terms of toddlers in the one to three year old range who are the victims of accidents which the invention is designed to prevent.

It should be mentioned that while the use of the spring 23 is preferred for positive action, the spring could be omitted and the locking arm 21 will operate by gravity when the lid is returned to the closed position.

Also, in some cases, the screws for attaching the bar 18 to the lid 13 can be omitted and the bar can be attached to the lid by state-of-the-art adhesive.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In a toilet fixture comprising a bowl having an upper level surface, a toilet seat and lid for the bowl pivotally mounted on a transverse pivot axis somewhat above the elevation of said upper level surface and a flush tank disposed rearwardly of said pivot axis and rising substantially above the upper surface of said bowl, the improvement comprising an elongated mounting bar fixed to said lid longitudinally and extending rearwardly of the lid to a point somewhat rearwardly of said transverse pivot axis when the lid is in a closed substantially level position, a comparatively short locking arm pivotally attached to the mounting arm near its rear end and somewhat rearwardly of said pivot axis on a second substantially parallel transverse pivot axis, a stop surface for the locking arm on the mounting bar limiting pivotal movement of the locking arm in one direction when the locking arm is in depending relationship to the mounting bar substantially at right angles thereto, and a spring connected between the locking arm and mounting bar and biasing the locking arm toward engagement with said stop surface, and the spring yielding to permit rotation of the locking arm on said second pivot axis away from the stop surface to a lid open position, the locking arm returning automatically to a lid closed locking position in contact with the stop surface when the lid is moved to a closed position.

2. In a toilet fixture as defined in claim 1, and the stop surface comprising a stop lug projecting from one side of the mounting bar in the path of swinging movement of the locking arm.

3. In a toilet fixture as defined in claim 2, and said spring comprising a retractile spring, and connecting lugs for opposite ends of the spring on the mounting bar and locking arm.

4. In a toilet fixture as defined in claim 3, and the locking bar having a generally square end face adapted to abut said upper level surface of said bowl.

5. A toilet seat lid lock comprising in combination with a toilet seat lid which is pivotally mounted on a first transverse pivot axis somewhat above the top surface of a toilet bowl with which said lid is associated, an elongated mounting bar fixed on said lid longitudinally and extending rearwardly of the lid to a location somewhat rearwardly of said first transverse pivot axis when the lid is in a closed substantially level position, a locking arm pivotally attached to the rear end of said mounting arm and being disposed rearwardly of said first transverse pivot axis on a second parallel transverse pivot axis, a stop surface for the locking arm on the mounting bar somewhat forwardly of said second transverse pivot axis and limiting pivotal movement of the locking arm in one direction when the locking arm is in depending substantially perpendicular relationship to said mounting bar, said locking arm having an end face adapted to abut the top surface of a toilet bowl with which said lid is associated to block raising of the lid on said first transverse pivot axis, and a spring connected between the locking arm and mounting bar and biasing the locking arm toward engagement with said stop surface, said spring yielding to allow rotation of said locking arm on said second transverse pivot axis to an angular position whereby said lid may be raised.

* * * * *